US008754340B2

(12) United States Patent
Prest et al.

(10) Patent No.: US 8,754,340 B2
(45) Date of Patent: Jun. 17, 2014

(54) MULTIPLE FUNCTION INLINE CONTROLLER WITH BUTTONS EXTENDING ALONG DIFFERENT AXES

(71) Applicant: Apple Inc., Cupertino, CA (US)

(72) Inventors: Christopher Prest, San Francisco, CA (US); Kurt Stiehl, Cupertino, CA (US); Cameron Frazier, Chicago, IL (US); Wim Crooijmans, San Jose, CA (US); Michelle Yu, Oakland, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 13/735,539

(22) Filed: Jan. 7, 2013

(65) Prior Publication Data

US 2013/0118877 A1 May 16, 2013

Related U.S. Application Data

(63) Continuation of application No. 12/239,500, filed on Sep. 26, 2008, now Pat. No. 8,350,167.

(60) Provisional application No. 61/041,160, filed on Mar. 31, 2008.

(51) Int. Cl.
*H01H 3/00* (2006.01)

(52) U.S. Cl.
USPC ..... 200/18

(58) Field of Classification Search
USPC ..... 200/18, 302.1, 302.2; 381/370, 74; 361/832
See application file for complete search history.

(56) References Cited

U.S. PATENT DOCUMENTS

| | | | | |
|---|---|---|---|---|
| 4,869,683 | A | 9/1989 | Nelson | |
| 5,821,480 | A | 10/1998 | Machida | |
| 6,007,377 | A | 12/1999 | Cook | |
| 7,011,213 | B2 | 3/2006 | Clark et al. | |
| 7,151,237 | B2 * | 12/2006 | Mahoney et al. | 200/512 |
| 2007/0223717 | A1 * | 9/2007 | Boersma | 381/74 |
| 2008/0187160 | A1 | 8/2008 | Kim | |

* cited by examiner

*Primary Examiner* — Vanessa Girardi
(74) *Attorney, Agent, or Firm* — Dorsey & Whitney LLP

(57) ABSTRACT

Methods, apparatus and systems which provide buttons oriented at angles relative to each other as a part of a multiple function switch are described. In one embodiment, the multiple function switch is part of an inline controller that is suitable for use to control features or functions of a portable electronic device. A multiple function switch may be incorporated in a cable associated with an earpiece arranged to be interfaced with a portable electronic device.

21 Claims, 8 Drawing Sheets

MULTIPLE FUNCTION INLINE CONTROLLER WITH BUTTONS EXTENDING ALONG DIFFERENT AXES

CROSS-REFERENCE TO RELATED APPLICATION

This application is a continuation of U.S. patent application Ser. No. 12/239,500, filed Sep. 26, 2008 (now U.S. Pat. No. 8,350,167), which claims priority to U.S. Provisional Patent Application No. 61/041,160, filed Mar. 31, 2008, both of which are incorporated herein by reference in their entirety.

BACKGROUND OF THE INVENTION

1. Field of the Invention

The present invention relates to remote switches and, more particularly, to inline remote switches (controllers) for portable electronic devices.

2. Description of the Related Art

Portable electronic devices, such as mobile phones, MP3 players and Personal Digital Assistants (PDAs), are often used by individuals on a personal basis. In other words, it is not uncommon for a person to carry a portable electronic device with them throughout their day. Often, these portable electronic devices store media data for subsequent playback by their user.

Many users keep their portable electronic device in his or her pocket or in a wearable holder, while at least partially controlling the device using a remote switch located on a headphone assembly. The use of "remote" switches to control portable electronic devices enhances the enjoyment of the portable electronic devices. Remote switches can also be referred to as controllers or remote controllers. By way of example, incorporating a remote switch onto a headphone assembly that is plugged into or otherwise interfaced with a portable electronic device allows a user to at least partially control the portable electronic device without accessing controls actually on the portable electronic device. Consequently, a remote switch (e.g., controller) can be used to at least partially control a portable electronic device remote from the portable electronic device itself.

If a remote switch is relatively large, it may be unwieldy. For example, if a relatively large remote switch is coupled to an earpiece assembly, a user may find the presence of the switch to be inconvenient and cumbersome. As such, the convenience of having a remote switch may be hindered. On the other hand, if a remote switch is relatively small, it may be difficult to activate accurately. For instance, if a relatively small remote switch is coupled to a headphone assembly and includes buttons which control different features of a portable electronic device, a user may inadvertently activate one feature while attempting to activate another feature, as actuating small buttons that are closely positioned can be difficult. Moreover, a user may wish to use a remote switch without looking at the remote switch. Hence, the user may effectively be using his or her sense of touch to identify a desired button to actuate. That is, the user may use his or her tactile senses to locate a desired button to actuate. When a remote switch is relatively small, there may be relatively high likelihood that the user will either actuate the wrong button on the switch, or may inadvertently actuate more than one button on the switch.

Therefore, there is a need for an improved controller that provides more accurate use yet is relatively small and easy to use.

SUMMARY OF THE INVENTION

The present invention pertains to a multiple function switch having buttons oriented at different angles. In one embodiment, the multiple function switch is part of an inline controller that is suitable for use to control features or functions of a portable electronic device. The present invention may be implemented in numerous ways, including, but not limited to, as a method, system, device, or apparatus. Example embodiments of the present invention are discussed below.

According to one aspect of the present invention, an apparatus can include a circuit board, a plurality of switches, a base, a first structural member, and a pliable member. The switches can be mounted on the circuit board along a first axis. The circuit board can support a first switch which can be arranged about a second axis, as well as a second switch which can be arranged about a third axis. The base can support the circuit board, and the first structural member can be positioned over the plurality of switches. The pliable member can fit substantially around the base and the first structural member. In one embodiment, the first structural member can be a polypropylene cap, while the pliable member can be either a silicone tube or a rubber tube.

According to another aspect of the present invention, an apparatus includes a circuit board on which a plurality of switches is mounted along a first axis. The circuit board can be arranged such that a first switch is arranged about a second axis and a second switch is arranged about a third axis, that is approximately perpendicular to the second axis. The apparatus can also include a cover arrangement which is positioned at least over the switches.

In accordance with still another aspect of the present invention, an apparatus can include a cable and an inline switch assembly. The inline switch assembly can be coupled to the cable, and include first, second, and third buttons that are aligned along a longitudinal axis. The second button can be oriented at an angle of up to approximately ninety degrees relative to the first button and the third button. The inline switch assembly can also include a circuit that supports the first button, the second button, and the third button.

According to still another aspect of the present invention, an inline controller, such as for use in controlling a portable electronic device, can include at least an inline switch assembly, wherein the inline switch assembly includes a plurality of user input surfaces aligned along a longitudinal axis, and wherein adjacent ones of the user input surfaces are oriented at different angles.

Other aspects and advantages of the invention will become apparent from the following detailed description taken in conjunction with the accompanying drawings which illustrate, by way of example, the principles of the invention.

BRIEF DESCRIPTION OF THE DRAWINGS

The invention will be readily understood by the following detailed description in conjunction with the accompanying drawings, in which.

DETAILED DESCRIPTION OF THE INVENTION

Example embodiments of the present invention are discussed below with reference to the various figures. However, those skilled in the art will readily appreciate that the detailed description given herein with respect to these figures is for explanatory purposes, as the invention extends beyond these embodiments.

The invention relates to methods and systems which provide buttons oriented at angles relative to each other as a part of a multiple function switch that may be used to control features or functions of a portable electronic device. In one embodiment, a switch is substantially inline with a cable that is interfaced with portable device. An inline switch may be relatively compact, and may be positioned on a cable associated with an earpiece that is arranged to be interfaced with, e.g., plugged into, a portable electronic device. The use of the inline switch allows functions or features of the portable electronic device to be controlled. For instance, if the portable electronic device is a digital media player, the inline switch may control playback of files on the digital media player. Alternatively, if the portable electronic device is a mobile (e.g., cellular phone), the inline switch may allow phone calls to be answered and/or terminated and also control the volume associated with the mobile phone.

The orientation of buttons or domes on an overall inline switch is typically critical, as it is often important to effectively ensure that a user of the overall inline switch is unlikely to accidentally actuate one button while trying to actuate another button. That is, the orientation of buttons is important to ensure that the buttons, which generally correspond to separate switches, may be separately activated. By orienting adjacent buttons along a longitudinal axis at different angles, a user may readily identify the different buttons, i.e., the user may differentiate between adjacent buttons. That is, by positioning buttons at different angles along a longitudinal axis, the buttons may effectively be separated such that they are less likely to be inadvertently substantially simultaneously activated. For example, if a volume control button and a call hang-up or termination button of an inline switch are oriented along a longitudinal axis at approximately ninety degrees relative to each other, a user may press the volume control button without accidentally pressing the call hang-up button and, thereby, prematurely terminating a phone call.

Figure 1:
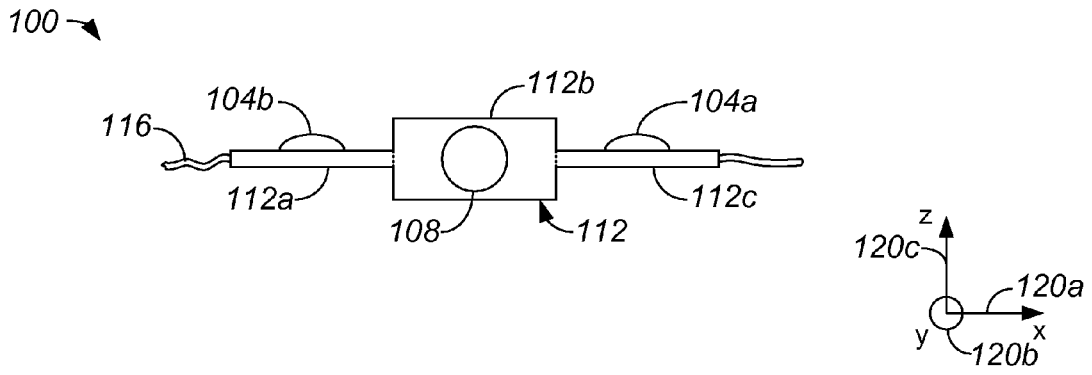
FIG. 1 is a block diagram representation of an inline switch arrangement in accordance with an embodiment of the present invention.

Referring initially to FIG. 1, an inline switch arrangement that includes adjacent buttons or domes placed inline along a longitudinal axis at different angles will be described in accordance with an embodiment of the present invention. An inline switch arrangement 100 includes a button plate board 112 with separate button plates 112*a-c* along an x-axis 120*a*. Button plate board 112 generally includes electronic circuitry and components (not shown) that enables inline switch arrangement 100 to be used to control features associated with a portable electronic device (not shown). Button plates 112*a-c* are arranged to enable buttons 104*a*, 104*b* and button 108 to be positioned along a longitudinal axis, e.g., x-axis 120*a*. As shown, button plate 112*a* supports a first button 104*a*, button plate 112*b* supports button 108, and button plate 112*b* supports a third button 104*a*.

In one embodiment, button plate board 112 is a flex circuit that is twisted such that such that buttons 104*a*, 104*b* are arranged to be actuated approximately along a z-axis 120*c*, while button 108 is arranged to be actuated approximately along a y-axis 120*b*. It should be appreciated, however, that button plate board 112 is not limited to being a twisted flex circuit. For example, circuit board 112 may instead be a hard printed circuit board or flex origami.

Button 108 or, more generally, an individual switch arrangement, can be configured to be positioned at approximately ninety degrees relative to buttons 104*a*, 104*b*. The positioning of button 108 at approximately ninety degrees relative to buttons 104*a*, 104*b* enables a user of inline switch arrangement 100 to efficiently activate or actuate button 108, without inadvertently activating at least one of buttons 104*a*, 104*b*. Similarly, the positioning of button 108 relative to buttons 104*a*, 104*b* as shown also enables a user to efficiently activate any of buttons 104*a*, 104*b* substantially without inadvertently activating button 108.

Buttons 104*a*, 104*b* and button 108 may be arranged to serve a variety of different purposes. When inline switch arrangement 100 is associated with an earpiece arrangement, e.g., when inline switch arrangement 100 is coupled to a cable 116 that terminates at one end to an earpiece (not shown) and at another end at a connection to a portable electronic device (not shown), buttons 104*a*, 104*b* and button 108 may be arranged to effectively "remotely" control functions of the portable electronic device. By way of example, buttons 104*a* may be arranged to substantially control the volume associated with the portable electronic device (not shown) such that one button 104*a* is arranged to cause the volume to increase and the other button 104*b* is arrange to cause the volume to decrease. Button 108 may be arranged to turn the portable electronic device (not shown) on and off, i.e., button 108 may effectively be an on/off switch or a play/pause switch. In one embodiment, if the portable electronic device (not shown) with which inline switch arrangement 100 is used is a cellular phone, button 108 may be arranged to answer a phone call and to hang up on a phone call, i.e., button 108 may effectively be an answer/hang-up switch.

Figure 2:
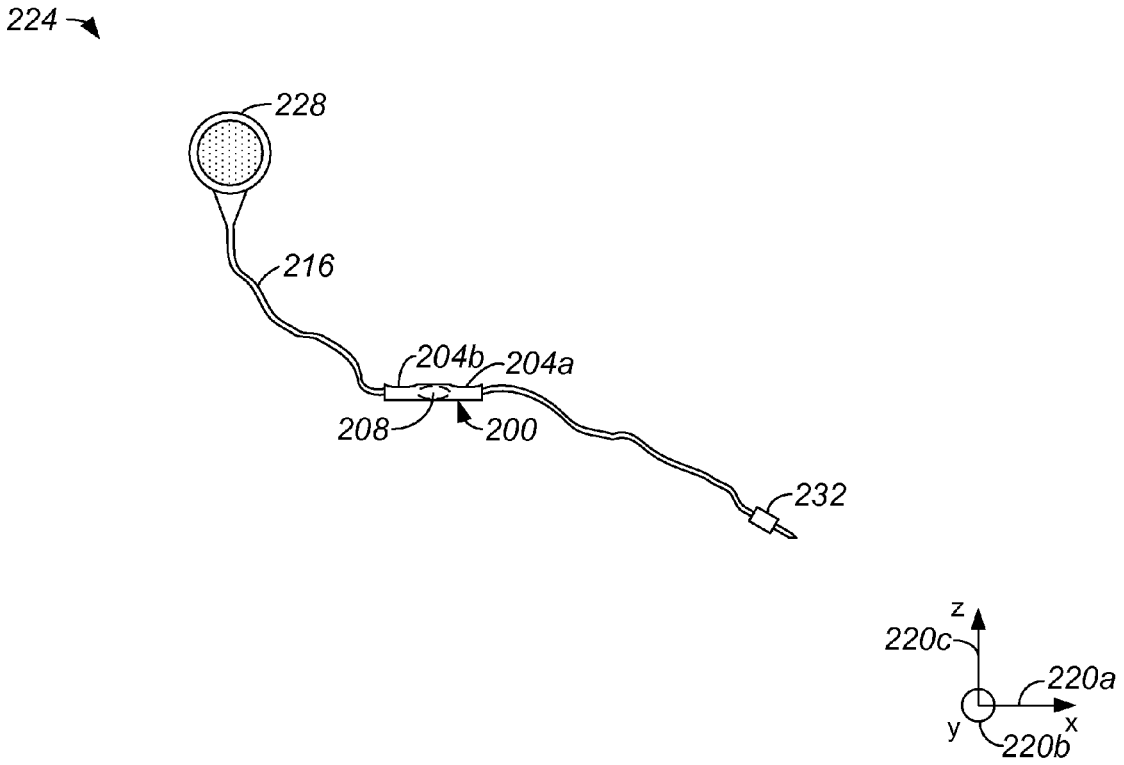
FIG. 2 is a diagrammatic representation of an inline switch arrangement that is a part of an earpiece assembly in accordance with an embodiment of the present invention.

As mentioned above, a multiple function inline switch may be a part of an earpiece assembly. FIG. 2 is a diagrammatic representation of an inline switch arrangement that is a part of an earpiece assembly in accordance with an embodiment of the present invention. An earpiece assembly 224 includes an earpiece 228 that is coupled to a cable 216. Earpiece 228 may be a part of an overall headset apparatus. Cable 216, as shown, terminates at an adapter or a plug 232. It should be appreciated that plug 232 is one configuration of a general interface which may be used to substantially connect earpiece assembly 224 to a portable electronic device.

An inline switch arrangement 200 is coupled to cable 216. Inline switch arrangement 200 is arranged to be substantially inline relative to cable 216, or substantially incorporated as a part of cable 216. Cable 216 may include two separate pieces, e.g., halves, that are coupled by inline switch arrangement 200, or cable 216 may be a substantially single piece that is incorporated into inline switch arrangement 200. Inline switch arrangement 200 includes buttons 204*a*, 204*b* and button 208. Buttons 204*a*, 204*b* and button 208 are substantially aligned relative to a longitudinal axis 220*a*. In the described embodiment, buttons 204*a*, 204*b* are arranged to be actuated when force is applied in a z-direction 220*c*, while button 208 is arranged to be actuated when force is applied in a y-direction 220*b*. Hence, button 208 is oriented at approximately ninety degrees from both button 204*a* and button 204*b*.

Figure 3A:
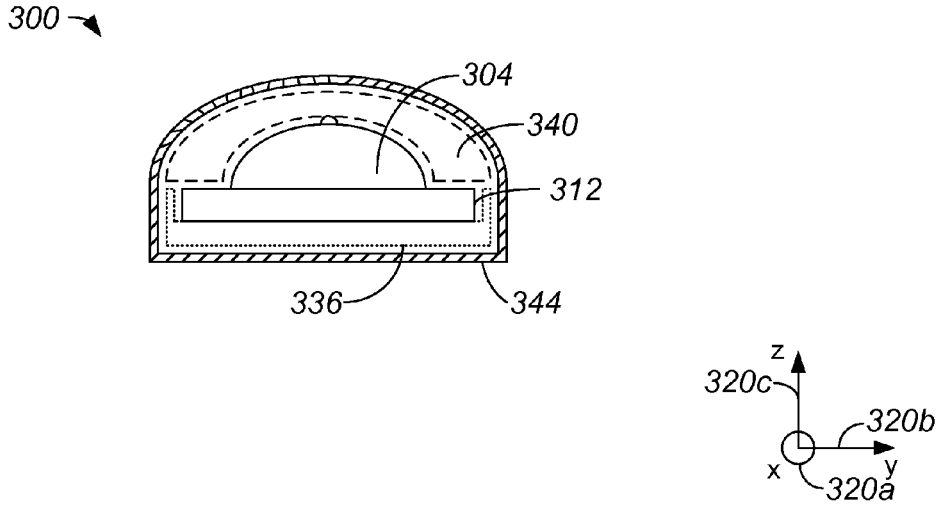
FIG. 3A is a cross-sectional side-view block diagram representation of an inline switch arrangement which includes a tube covering in accordance with an embodiment of the present invention.
Figure 3B:
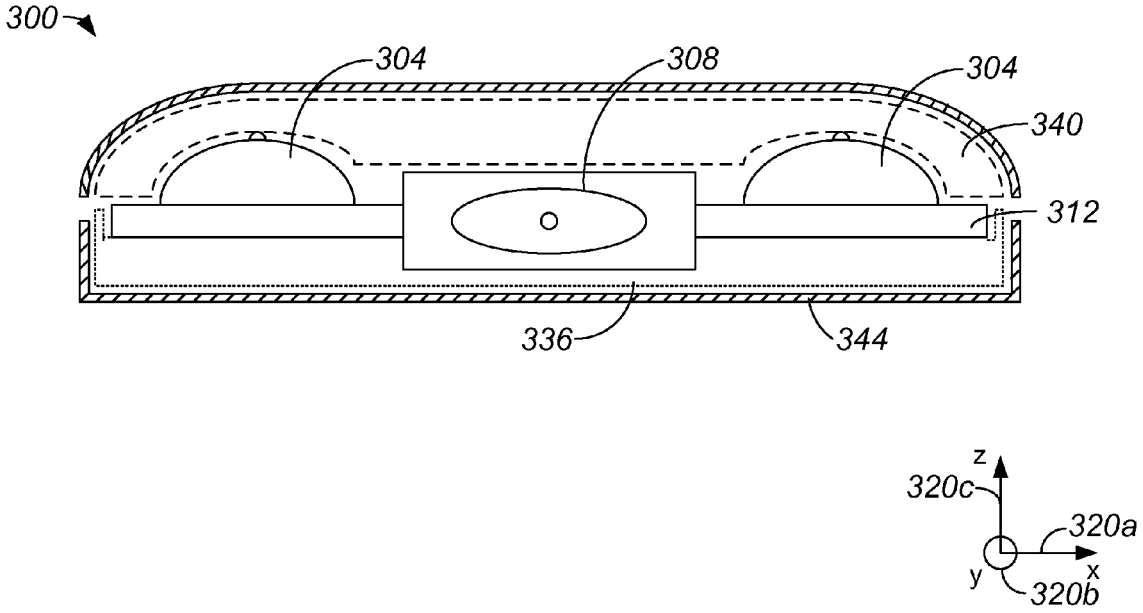
FIG. 3B is side-view block diagram representation of the inline switch arrangement of FIG. 3A in accordance with an embodiment of the present invention.

An inline switch arrangement or assembly such as inline switch arrangement 200 generally includes a cover arrangement that protects buttons and circuitry, and also provides structural support within inline switch arrangement 200. A cover arrangement may be relatively flexible, or may be relatively inflexible. With reference to FIGS. 3A and 3B, an inline switch arrangement with a relatively flexible cover will be described in accordance with an embodiment of the present invention, and with reference to FIGS. 5A and 5B, an inline switch arrangement with a relatively inflexible cover will be described in accordance with an embodiment of the present invention.

FIGS. 3A and 3B are representations of an inline switch arrangement which includes a relatively flexible cover in accordance with an embodiment of the present invention. FIG. 3A is a side-view representation of an inline switch arrangement 300 taken in an xy-plane, while FIG. 3B is a side-view representation of inline switch arrangement 300 associated with an xz-plane. Inline switch arrangement 300 includes a board 312 which, in one embodiment, is a flex circuit. Buttons 304, 308 are mounted on board 312 such that button 308 is arranged to be actuated when pressed in a y-direction 320*b*, while buttons 304 are arranged to be actuated when pressed in a z-direction 320*c*. In general, buttons 304, 308 are substantially aligned along a longitudinal axis 320*a*.

Board 312 is supported in a carrier base or a frame 336, which may be formed from substantially any suitable material, such as plastic. A cap 340 can be positioned over board 312 and buttons 304, 308 to provide protection for board 312 and buttons 304, 308. Cap 340 may be formed from a material such as polypropylene, or substantially any other suitable material. Generally, cap 340 is shaped to substantially cover buttons 304, 308. In one embodiment, cap 340 may be shaped such that landing points are substantially positioned over buttons 304, 308. Landing points will be discussed below with reference to FIGS. 9A and 9B. In general, landing points enable a user of inline switch arrangement 300 to effectively feel where buttons 304, 308 are located.

A tube 344, or a relatively flexible cover, is arranged over cap 340 and frame 336. Tube 344, which is typically formed from a soft, pliable material, is fitted over cap 340 and frame 336 and may serve to maintain cap 340 and frame 336 in desired orientations relative to each other. That is, tube 344 may effectively hold cap 340 and frame 336 substantially against each other with board 312 therebetween. The soft, pliable material from which cap 340 is formed may include, but is not limited to including, silicone and other stretchable materials.

Figure 4:
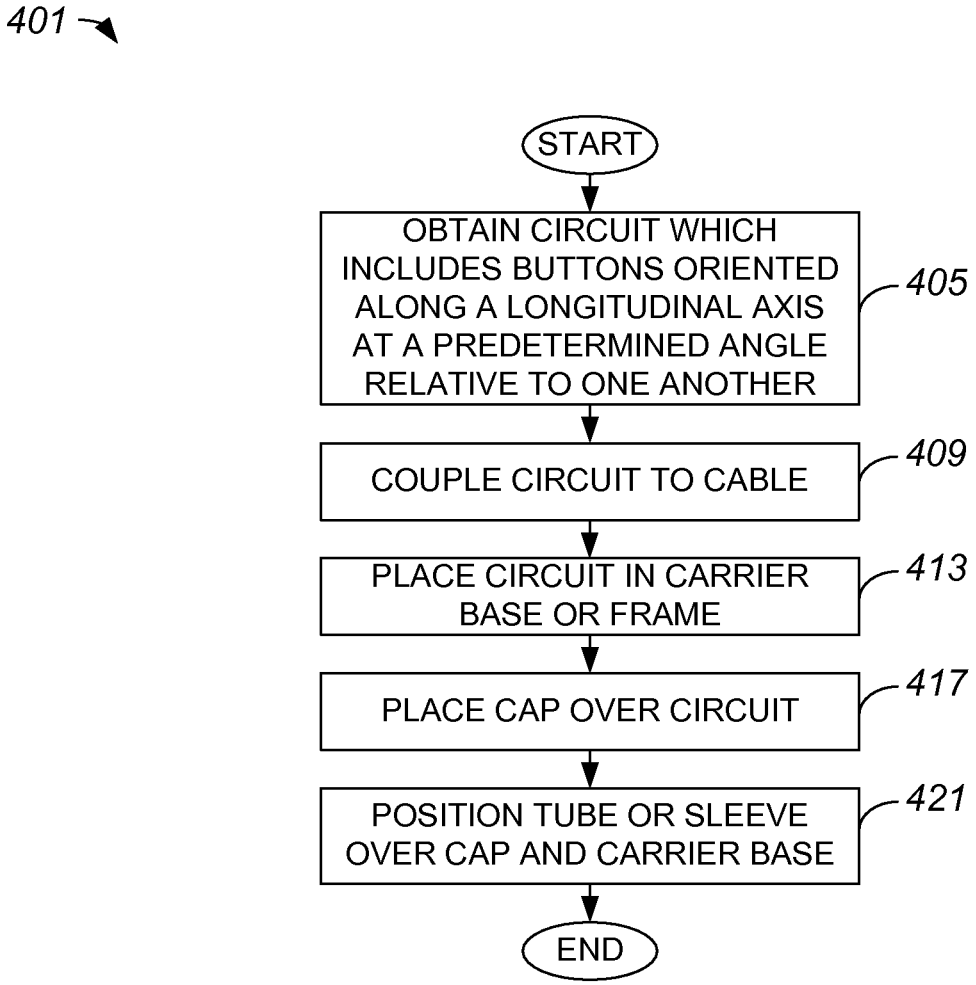
FIG. 4 is a process flow diagram which illustrates a method of forming an inline switch arrangement which includes a tube covering in accordance with an embodiment of the present invention.

FIG. 4 is a process flow diagram which illustrates a method of forming an inline switch arrangement which includes a tube covering in accordance with an embodiment of the present invention. A process 401 of forming an inline switch arrangement which includes a tube covering, e.g., a relatively soft covering, begins at step 405 in which a circuit or a board is obtained. The circuit typically includes buttons oriented approximately along a longitudinal axis at a predetermined angle relative to one another. As previously described, in one example, the predetermined angle may be approximately ninety degrees. In one embodiment, the circuit may be a flex circuit that is twisted to enable the buttons to be oriented at a predetermined angle relative to one another.

After the circuit is obtained, the circuit is coupled to a cable in step 409. Coupling the circuit to a cable, e.g., a cable associated with an earpiece or a headset assembly, may include soldering portions of the cable to portions of the circuit. Once the circuit is coupled to the cable, the circuit is placed in a carrier base or frame in step 413. Then, in step 417, a cap is placed over the circuit. The cap, which may be formed from polypropylene, may be substantially interlocked with the carrier base, in one embodiment. Placing the cap over the circuit may include aligning the cap appropriately over the circuit such that appropriate portions of the cap are positioned over buttons on the circuit. Additionally, placing the cap over the circuit may include adding structures, e.g., shims, between the cap and the circuit to provide structural support for the cap.

In step 421, a tube or a sleeve is positioned over the cap and the carrier base. Positioning the tube over the cap and the carrier base may include sliding the tube over the cap and the carrier base. The tube, which may be formed from silicone, may include grooves or other structural features on an inner surface that are configured to prevent tube from sliding off of the cap and the carrier base. Once the tube is positioned over the cap and the carrier base, the process of forming an inline switch arrangement is completed.

Figure 5A:
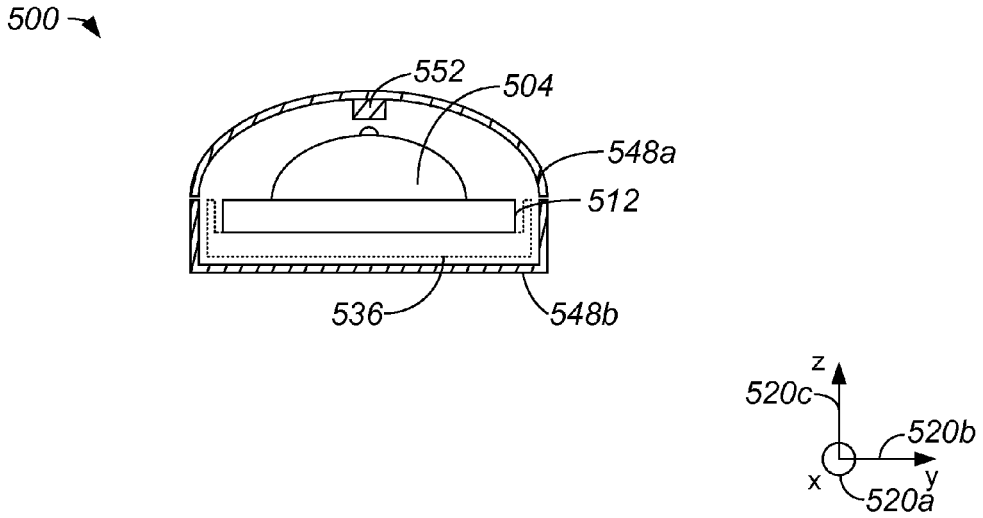
FIG. 5A is a cross-sectional side-view block diagram representation of an inline switch arrangement which includes a shell cover in accordance with an embodiment of the present invention.
Figure 5B:
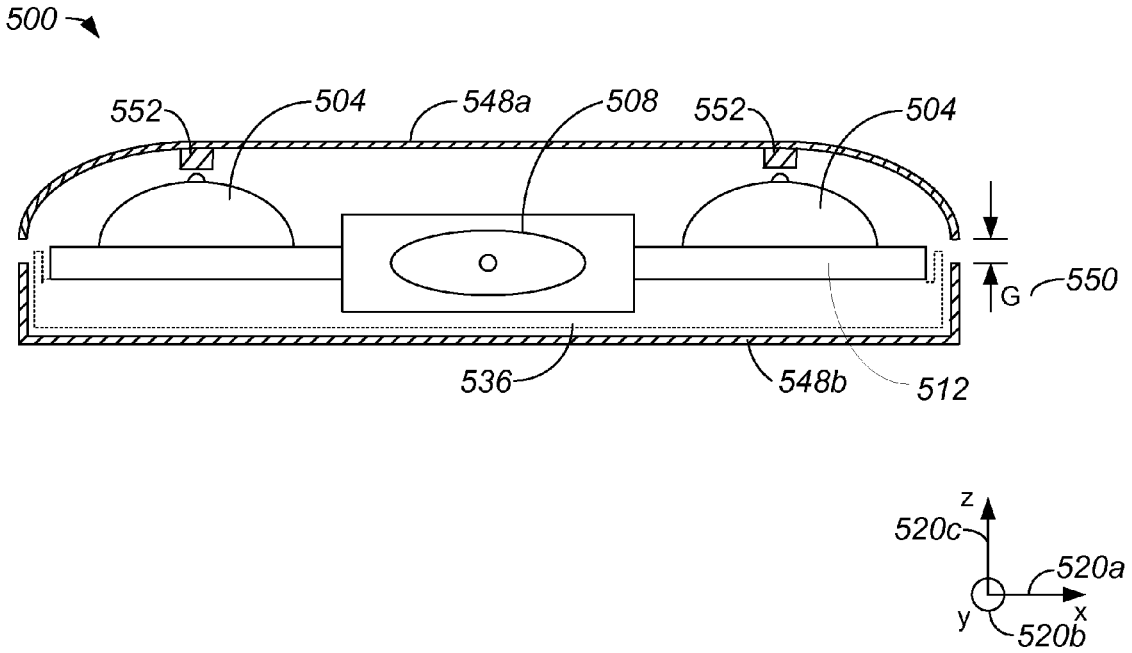
FIG. 5B is side-view block diagram representation of the inline switch arrangement of FIG. 5A in accordance with an embodiment of the present invention.

As previously mentioned, an inline switch arrangement may include a relatively inflexible cover, e.g., a hard cover, in lieu of a flexible cover, e.g., a tube. With reference to FIGS. 5A and 5B, an inline switch arrangement which includes a hard or stiff cover will be described in accordance with an embodiment of the present invention. FIG. 5A is a side-view representation of an inline switch arrangement 500 taken in an xy-plane, while FIG. 5B is a side-view representation of inline switch arrangement 500 associated with an xz-plane. Inline switch arrangement 500 includes a board 512 in which buttons 504, 508 are supported along a longitudinal axis 520*a*. Board 512 may be, in one embodiment, a flex circuit that is substantially twisted to enable button 508 to be actuated when pressed in a y-direction 520*b*, while buttons 504 may be actuated when pressed in a z-direction 520*c*.

Board 512 is supported in a carrier base or a frame 536 which, in turn, is positioned in a bottom shell 548*b*. A top shell 548*a* is positioned over board 512 and buttons 504, 508 to provide protection for board 512 and buttons 504, 508. Top shell 548*a* may be fixed to board 512, while bottom shell 548*b* may be fixed to frame 536. Top shell 548*a* may be fixed or otherwise coupled to board 512 using a structural member (not shown) and/or adhesive. By way of example, top shell

548*a* may be fixed to board 512 using a structural member (not shown) that is positioned between buttons 504. Similarly, bottom shell 548*b* may be fixed to frame 536 using a structural member (not shown) and/or adhesive.

Top shell 548*a* and bottom shell 548*a* effectively form a cover for inline switch arrangement 500. In general, top shell 548*a* may be shaped to define landing points that essentially identify the location of buttons 504, 508 located under top shell 548*a*. Top shell 548*a* and bottom shell 548*b* may be formed from a material such as plastic, although top shell 548*a* and bottom shell 548*b* are not limited to being formed from plastic.

To facilitate the actuation of buttons 504, 508 when force is applied to the cover formed by top shell 548*a* and bottom shell 548*b*, posts 552 may provided on top shell 548*a*. As shown, posts 552 are aligned with buttons 504. Alternatively, or in addition to posts 552, shims or other support members (not shown) may be provided on top shell 548*a* and/or board 512 to protect against collateral actuation of buttons 504, 508. By way of example, shims (not shown) may be added between buttons 504 to prevent forces which are applied to actuate one button 504 from also actuating the other button 504. Such shims (not shown) may also serve to effectively couple top shell 548*a* to board 512.

In one embodiment, a gap G 550 is present between top shell 548*a* and bottom shell 548*b* to compensate for the amount of travel associated with buttons 504. When buttons 504 are actuated, for instance, they may travel up to around approximately 0.2 millimeters (mm) relative to z-direction 520*c*. Hence, gap G 550 may be sized such that when substantially no force is applied to either top shell 548*a* or bottom shell 548*b*, gap G 550 is greater than approximately 0.2 mm, e.g., gap G 550 may be approximately 0.25 mm. Generally, gap G 550 may be chosen to be larger than the expected amount of travel associated with buttons 504. Gap G 550 may be located at corners of inline switch arrangement 500 such that button 508, for example, may move up and down.

Figure 6:
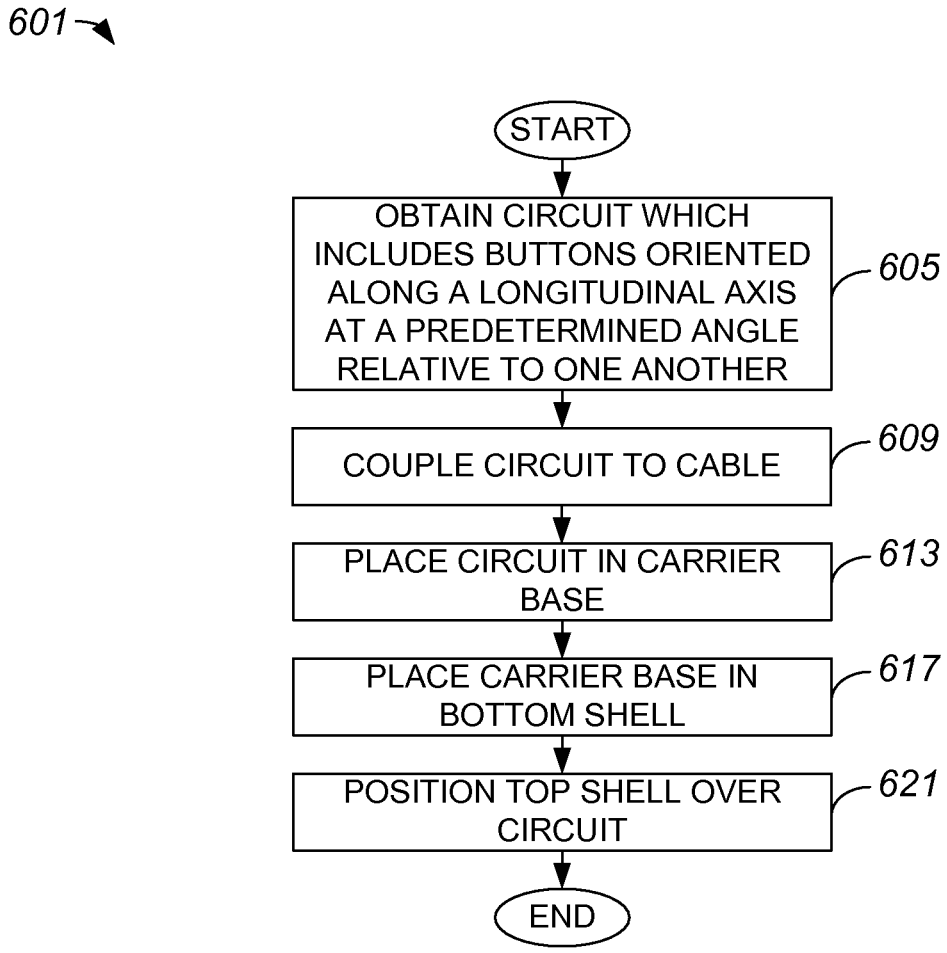
FIG. 6 is a process flow diagram which illustrates a method of forming an inline switch arrangement which includes a shell cover in accordance with an embodiment of the present invention.

Referring next to FIG. 6, a method of forming an inline switch arrangement which includes a cover formed from a top shell and a bottom shell will be described in accordance with an embodiment of the present invention. A process 601 of forming an inline switch arrangement which includes a cover begins at step 605 in which a circuit is obtained. The circuit or board typically includes buttons oriented approximately along a longitudinal axis at a predetermined angle relative to one another. The circuit may be a flex circuit that is twisted to enable the buttons to be oriented at the predetermined angle relative to one another.

Once the circuit is obtained, the circuit is coupled to a cable in step 609. Upon coupling the circuit to the cable using any suitable method, the circuit is placed in a carrier base or frame in step 613. After the circuit is placed in the carrier base, the carrier base is placed in a bottom shell in step 617. Placing the carrier base in the bottom shell may include coupling the carrier base to the bottom shell such that the carrier base is effectively secured to the bottom shell.

From step 617, process flow moves to step 621 in which a top shell is positioned over the circuit. Positioning the top shell over the circuit may include aligning the top shell over the circuit such that appropriate portions of the top shell are positioned over buttons on the circuit, and such that an appropriate gap may be maintained between the top shell and the bottom shell. In addition, positioning the top shell over the circuit may include coupling the top shell to the circuit, e.g., using a structural member or a shim. That is, positioning the top shell over the circuit may include effectively coupling the top shell to the bottom shell. After the top shell is positioned, the process of forming an inline switch arrangement is completed.

Figure 7:
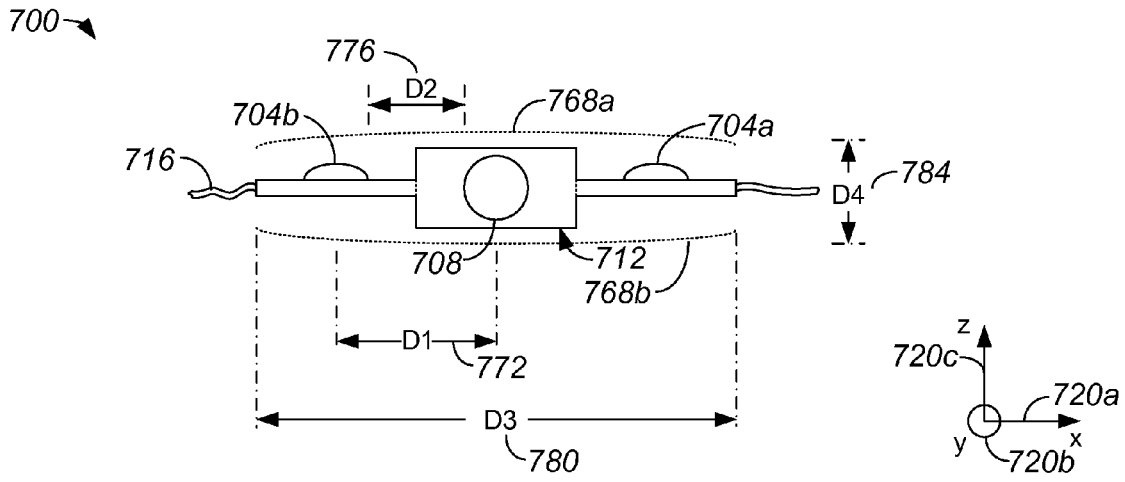
FIG. 7 is a block diagram representation of various dimensions associated with an inline switch in accordance with an embodiment of the present invention.

The dimensions associated with an inline switch arrangement or a multiple function inline switch may vary. With reference to FIG. 7, one set of suitable dimensions associated with a multiple function inline switch will be described in accordance with an embodiment of the present invention. An inline switch arrangement 700 includes a button plate board 712 which, in the described embodiment, is a flex circuit. Buttons 704*a*, 704*b* and 708 are located on board 712, and are positioned along a longitudinal axis 720*a* such that button 708 is oriented at approximately ninety degrees relative to buttons 704*a*, 704*b*. As shown, button 708 is arranged to be actuated when a force is applied along a y-axis 720*b*, while buttons 704*a*, 704*b* are arranged to be actuated when a force is applied along a z-axis 720*c*.

Button 704*b* and button 708 are such that a distance D1 772 between an axial centerline of button 704*b* and a line through button 708 may be approximately 3 mm or more. The separation between button 704*b* and button 708 is a distance D2 776, which may be approximately 5 mm or more. The overall width D3 780 of inline switch arrangement 700 along longitudinal axis 720*a* may be approximately 10 mm (e.g., 20 mm).

As discussed above, an inline switch may generally include either a tube or a shell. In general, a tube or a shell effectively define a top surface 768*a* and a bottom surface 768*b* of inline switch arrangement 700. Top surface 768*a* and bottom surface 768*b* may be surfaces of a tube, e.g., a silicone tube, or surfaces of a shell. A height D4 784 of inline switch arrangement 700, as measured along z-axis 720*c* between top surface 768*a* and bottom surface 768*b*, may be in the range of between approximately 2 mm and 5 mm.

Figure 8:
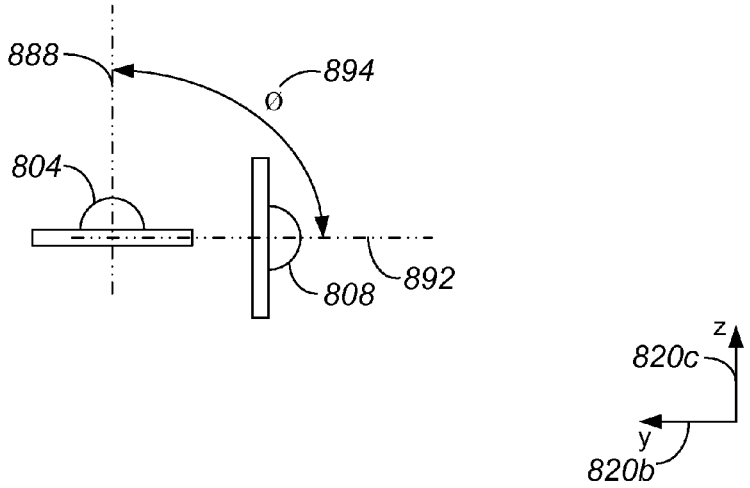
FIG. 8 is a block diagram representation of an angle between button positioned inline along a longitudinal axis in accordance with an embodiment of the present invention.

The relative angle at which buttons are oriented relative to each other may vary. FIG. 8 is a block diagram representation of an angle between button positioned inline along a longitudinal axis in accordance with an embodiment of the present invention. A button 804 is arranged to be actuated along an axis 888 that is associated with a z-direction 820*c*, while a button 808 is arranged to be actuated along an axis 892 that is associated with a y-direction 820*b*. More generally, button 804 is arranged about axis 888, while button 808 is arranged about axis 892. For ease of illustration, buttons 804, 808 are illustrated as being separate pieces, although it should be appreciated that buttons 804, 808 may typically be substantially aligned along a common longitudinal axis. In addition, although a single button 804 which may be actuated in z-direction 820*c* is shown, it should be appreciated that there is generally at least a second button (not shown) which may be actuated in z-direction 820*c*.

Axis 888 and axis 892 are separated by an angle Ø 894. Hence, button 808 is oriented about angle Ø 894 relative to button 804. In the described embodiment, angle Ø 894 may be approximately ninety degrees. It should be appreciated, however, that angle Ø 894 is not limited to being approximately ninety degrees. By way of example, angle Ø 894 may be between approximately ninety degrees and approximately 180 degrees. Alternatively, angle Ø 894 may be substantially any angle that is greater than zero degrees and less than 360 degrees. Typically, adjacent buttons will positioned at angular positions that different from about at least 20 degrees up to about 340 degrees.

In order to facilitate the ability of a user to identify the relative locations of buttons of an inline switch, the overall shape of the inline switch may include landing points. By way of example, a cap or a hard shell of an inline switch may be shaped or otherwise configured to include landings that may be readily identified by touch. An inline switch may include a landing associated with each button such that a user may feel the inline switch, e.g., run his or her finger along the length of the inline switch, to determine where each button is approximately located.

Figure 9A:
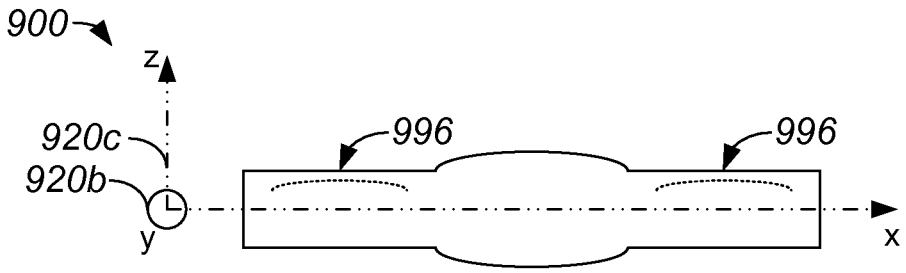
FIG. 9A is a diagrammatic side-view representation of an inline switch arrangement which depicts two landing points associated with buttons in accordance with an embodiment of the present invention.
Figure 9B:
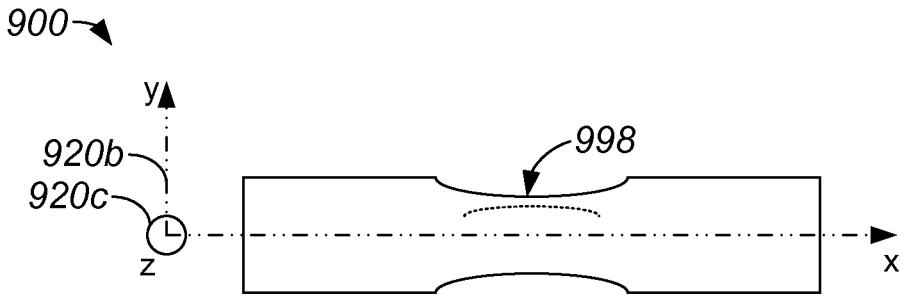
FIG. 9B is a diagrammatic side-view representation of an inline switch arrangement, e.g., inline switch arrangement 900 of FIG. 9A, which depicts a middle landing point in accordance with an embodiment of the present invention.

FIGS. 9A and 9B are diagrammatic side-view representations of an inline switch arrangement which is shaped to include landing points that are associated with buttons in accordance with an embodiment of the present invention. An inline switch arrangement 900 is shaped such that it includes three landing points 996, 998 which correspond to three buttons contained associated with inline switch arrangement 900. Landing points 996 correspond to buttons that are arranged to be activated by the application of forces in a z-direction 920*c*, while landing point 998 corresponds to a button that is arranged to be activated by the application of a force in a y-direction 920*b*.

A user may identify landing points 996, 998 by feeling inline switch arrangement 900 for indentations. For example, a user may use his or her fingers to locate landing point 998 as an indentation substantially near a middle portion of inline switch arrangement 900. Hence, by pressing on landing point 998, the user may be fairly certain that he or she is actuating an underlying button. As landing point 998 is associated with a button that is at approximately a ninety degree angle from the buttons associated with landing points 996, the user may press on or apply force to landing point 998 in y-direction 920*b* substantially without inadvertently pressing on landing points 996.

Figure 10:
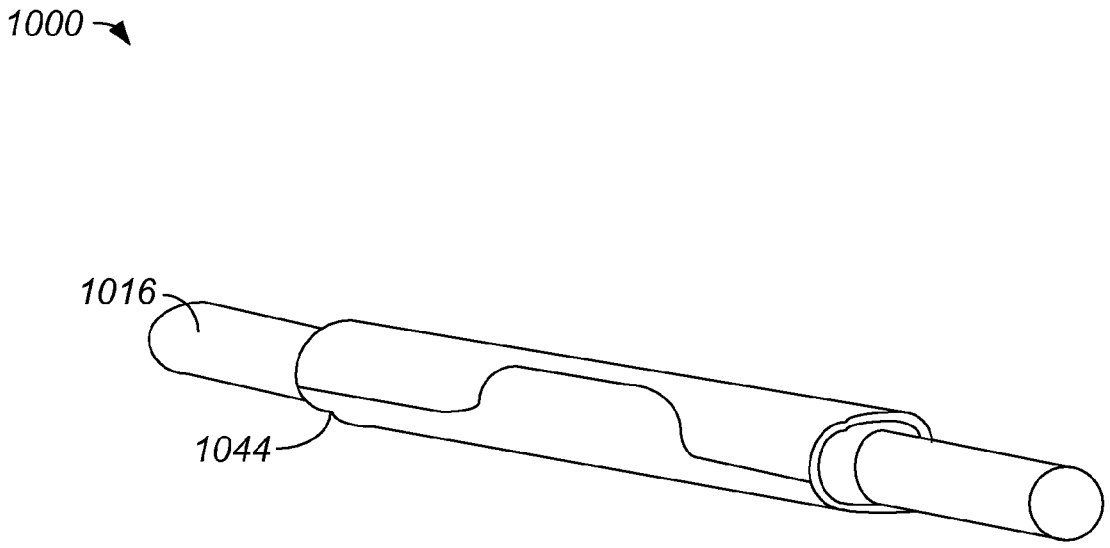
FIG. 10 is a diagrammatic three-dimensional representation of an inline switch arrangement in accordance with an embodiment of the present invention.

FIG. 10 is a diagrammatic perspective representation of one embodiment of an inline switch arrangement in accordance with an embodiment of the present invention. An inline switch arrangement 100 includes a cable 1016 and a switch cover 1044. Switch cover 1044 may be substantially any covering which fits over buttons (not shown) of switch arrangement 1000 and allows the buttons to be actuated therethrough. By way of example, switch cover 1044 may be formed as a relatively hard shell or as a flexible tube member.

Although only a few embodiments of the present invention have been described, it should be understood that the present invention may be embodied in many other specific forms without departing from the spirit or the scope of the present invention. By way of example, while an inline switch within which buttons or individual switch arrangements are positioned at different angles along a longitudinal axis has been described as including three buttons, an inline switch may generally include any number of buttons. That is, an inline switch may include fewer than or more than three buttons. In general, buttons may be arranged such that alternating buttons are arranged at different angles. For instance, an inline switch which includes four buttons may include a first button arranged to be actuated along a y-axis, an adjacent second button arranged to be actuated along a z-axis, a third button arranged to be actuated along the y-axis that is adjacent to the opposite side of the second button from the first button, and a fourth button arranged to be actuated along the z-axis that is adjacent to the opposite side of the third button from the second button.

A post such as post 552 of FIGS. 5A and 5B may be incorporated into a cap, e.g., a polypropylene cap, in an inline switch with a tube covering without departing from the spirit or the scope of the present invention. Such a post may be arranged to facilitate the actuation of a button. Additionally, various shims may be incorporated into a cap, and/or onto a flex circuit, to prevent a deflection of the cap from causing a button to be inadvertently actuated.

A multiple function inline switch has been shown and described as being incorporated into an earpiece assembly. It should be understood that such a switch is not limited to being associated with an earpiece assembly. By way of example, a multiple function inline switch may be included in, but is not limited to being included in, a headset assembly, an earpiece assembly, a microphone assembly or an assembly that includes both an earpiece and a mouthpiece.

The shape of a cap, e.g., a polypropylene cap or piece, of an inline switch that is to be positioned over buttons and under a tube, e.g., a silicone tube, may vary widely. For instance, a cover piece may be shaped to include indentations which are to be positioned over buttons. As such, the ability of a user to "feel" where the various buttons of an inline switch are located relative to one another may be facilitated. Similarly, the shape of a hard shell cover may also vary widely.

Buttons on a multiple function inline switch may be oriented at different angles relative to one another. By way of example, a middle button of a three button switch may be oriented at one angle relative to a first button, and at a second angle relative to a second button. Generally, however, the middle button of a three button switch is oriented at substantially the same angle relative to a first button and relative to a second button.

In general, an inline switch has been described as including a plurality of buttons. Each button that is included in an overall inline switch arrangement may be associated with a separate switch. In other words, an inline switch arrangement effectively includes a plurality of components that are individual switches. Such individual switches may be embodied as buttons. That is, a button is an example of a part of a component switch which is included in an overall inline switch arrangement. It should be appreciated, however, that although buttons are described, component switches of an overall inline switch arrangement are not limited to having buttons.

The steps associated with the methods of the present invention may vary widely. Steps may be added, removed, altered, combined, and reordered without departing from the spirit of the scope of the present invention. Therefore, the present examples are to be considered as illustrative and not restrictive, and the invention is not to be limited to the details given herein, but may be modified within the scope of the appended claims.

The invention claimed is:

1. A multi-button switch apparatus comprising:

a circuit board;

a plurality of buttons electrically connected to the circuit board and arranged along a longitudinal axis of the circuit board;

a single moveable cover disposed around each of the circuit board and each button of the plurality of buttons to form a single unit, wherein the single moveable cover is operative to interact with each button of the plurality of buttons; and a cap comprising:

an uninterrupted surface and at least one contour;

wherein the cap and the at least one contour are positioned over the circuit board and the plurality of buttons such that the cap is disposed between the single moveable cover and the plurality of buttons.

2. The multi-button switch apparatus of claim 1, wherein the single moveable cover is operative to interact with each button of the plurality of buttons to control at least one audio playback operation of an electronic device.

3. The multi-button switch apparatus of claim 1, wherein the single moveable cover is operative to interact with the third button by moving in a direction opposite the second direction.

4. The multi-button switch apparatus of claim 1, wherein the single moveable cover is flexible.

5. The multi-button switch apparatus of claim 1, wherein the circuit board comprises a flexible circuit board.

6. The multi-button switch apparatus of claim 1, wherein the plurality of buttons comprises: a first button and a second button each disposed to face a first direction; and a third button disposed to face a second direction orthogonal to the first direction.

7. The multi-button switch apparatus of claim 6, wherein the single moveable cover is operative to interact with each of the first button and the second button by moving in a direction opposite the first direction.

8. The multi-button switch apparatus of claim 1, wherein the cap comprises a plurality of landing points that each of which correspond to a corresponds to a button of the plurality of buttons.

9. The multi-button switch apparatus of claim 8, wherein each landing point of the plurality of landing points comprises a respective indentation of the cap.

10. An apparatus comprising:

a circuit board;

a plurality of switches coupled to the circuit board along a longitudinal axis of the circuit board and comprising:

a first depressible switch facing a first direction and configured to be actuated from the first direction; and a second depressible switch facing a second direction that is different from the first direction and configured to be actuated from the second direction;

a cap comprising:

an uninterrupted surface and at least one contour;

wherein the cap and the at least one contour are positioned over the circuit board and at least one of the plurality of switches; and a flexible member configured to:

surround the cap, the circuit board and the plurality of switches to form a single unit and enable interaction with each switch of the plurality of switches, wherein the flexible member comprises a tube.

11. The apparatus of claim 10, wherein the plurality of switches further comprises a third switch facing the second direction.

12. The apparatus of claim 10, wherein the first direction is orthogonal to the second direction.

13. The apparatus of claim 10 further comprising a carrier base configured to support the circuit board.

14. The apparatus of claim 13, wherein the flexible member is further configured to surround the carrier base.

15. An apparatus comprising:

a circuit board having a plurality of user input surfaces coupled along a first axis of the circuit board, wherein a first user input surface of the plurality of user input surfaces resides on a first portion of the circuit board and is actuated along a second axis, and wherein a second user input surface of the plurality of user input surfaces resides on a second portion of the circuit board and is actuated along a third axis;

a cap comprising:

an uninterrupted surface having a shape that covers at least one of the first user input surface and the second user input surface, as well as the circuit board; and a tube disposed around the cap, the circuit board, the first user input surface, and the second user input surface to form a single unit, and configured to interact with each of the first user input surface and the second user input surface.

16. The apparatus of claim 15, wherein the tube is composed of flexible material.

17. The apparatus of claim 15, wherein the cap comprises a first indent that corresponds to the first user input surface and a second indent that corresponds to the second user input surface.

18. The apparatus of claim 15, wherein the circuit board further comprises a third portion, and wherein the first portion of the circuit board is disposed between the second portion of the circuit board and the third portion of the circuit board.

19. The apparatus of claim 18 wherein a third user input surface of the plurality of user input surfaces resides on the third portion of the circuit board.

20. The apparatus of claim 19, wherein the first user input surface is configured to at least one of turn ON an electronic device, turn OFF the electronic device, effect the electronic device to playback audio, and effect the electronic device to pause audio playback.

21. The apparatus of claim 20, wherein the second user input surface is configured to increase a volume setting of the electronic device and the third user input surface is configured to decrease the volume setting.

* * * * *

UNITED STATES PATENT AND TRADEMARK OFFICE

CERTIFICATE OF CORRECTION

PATENT NO. : 8,754,340 B2
APPLICATION NO. : 13/735539
DATED : June 17, 2014
INVENTOR(S) : Chritopher Prest et al.

It is certified that error appears in the above-identified patent and that said Letters Patent is hereby corrected as shown below:

In the Claims

Column 11 line 20, delete “corresponds to a”.

Signed and Sealed this
Nineteenth Day of August, 2014

Michelle K. Lee

Michelle K. Lee
*Deputy Director of the United States Patent and Trademark Office*